US005267317A

United States Patent [19]

Kleijn

[11] Patent Number: 5,267,317

[45] Date of Patent: Nov. 30, 1993

[54] METHOD AND APPARATUS FOR SMOOTHING PITCH-CYCLE WAVEFORMS

[75] Inventor: Willem B. Kleijn, Basking Ridge, N.J.

[73] Assignee: AT&T Bell Laboratories, Murray Hill, N.J.

[21] Appl. No.: 990,830

[22] Filed: Dec. 14, 1992

Related U.S. Application Data

[63] Continuation of Ser. No. 778,560, Oct. 18, 1991, abandoned.

[51] Int. Cl.[5] ..... G10L 9/00

[52] U.S. Cl. ..... 381/38; 381/49; 381/53; 395/2.16; 395/2.7

[58] Field of Search ..... 381/36-40, 381/49-51, 53

[56] References Cited

U.S. PATENT DOCUMENTS

| | | | |
|---|---|---|---|
| 4,074,069 | 2/1978 | Tokura et al. | 381/38 |
| 4,301,329 | 11/1981 | Taguchi | 381/37 |
| 4,390,747 | 6/1983 | Sampei et al. | 381/49 |
| 4,486,900 | 12/1984 | Cox et al. | 381/38 |
| 4,817,154 | 3/1989 | Hoyer | 381/37 |
| 4,899,385 | 2/1990 | Ketchum et al. . | |
| 4,910,781 | 3/1990 | Ketchum et al. . | |
| 4,982,433 | 1/1991 | Yajima et al. | 381/49 |
| 5,003,604 | 3/1991 | Okazaki et al. | 381/89 |

OTHER PUBLICATIONS

M. Copperi, "Efficient Excitation Modeling in a Low Bit-Rate CELP Coder," ICASSP'91, vol. 1, 233-235, May 14, 1991.

P. Kroon et al., "Pitch Predictors with High Temporal Resolution," ICASSP'90, vol. 2, 661-664, Apr. 3, 1990.

U. Heute, "Medium-Rate Speech Coding-Trial of a Review," Speech Communication, vol. 7, 125-149, 1988.

European Speech Report.

B. S. Atal and M. R. Schroeder, "Stochastic Coding of Sperd at Very Low Bit Rates", Proc. Int. Conf. Comm., Amsterdam, pp. 1610-1613 (1984).

Masaaki Honda, "Speech Coding using Waveform Matching based on LPC residual Phase Equalization", pp. 213-216 (1990).

Yair Shoham, "Constrained-Stochastic Excitation Coding of Speech at 4.8 KB/S", Advances in Speech Coding, pp. 339-348 (1991).

T. Taniguchi et al., "Pitch Sharpening for Perceptually Improved CELP, and the Sparse-Delta Codebook for Reduced Computation", Proc. Int. Conf. Acoust. Speech and Sign. Process., pp. 241-244 (1991).

C. G. Bell et al., "Reduction of Speech Spectra by Analysis-by-Synthesis Techniques", J. Acoust. Soc. Am., pp. 1725-1736 (1961).

S. Singhal and B. S. Atal, "Improving Performance of Multi-Pulse LPC Coders at Low Bit Rates", Proc. Int. Conf. Acoust. Speech and Sign. Process., pp. 1.3.1-1.3.4 (1984).

(List continued on next page.)

*Primary Examiner*—Robert L. Richardson
*Assistant Examiner*—Kee M. Tung
*Attorney, Agent, or Firm*—Thomas A. Restaino

[57] ABSTRACT

A method and apparatus for processing a reconstructed speech signal from an analysis-by-synthesis decoder are provided to improve the quality of reconstructed speech. By operation of the invention, one or more traces in a reconstructed speech signal are identified. Traces are sequences of like-features in the reconstructed speech signal. The like-features are identified by time-distance data received from the long term predictor of the decoder. The identified traces are smoothed by one of the known smoothing techniques. A smoothed version of the reconstructed speech signal is formed by combining one or more of the smoothed traces. The original reconstructed speech signal may be that provided by a long term predictor of the decoder. Values of the reconstructed speech signal and smoothed speech signal may be combined based on a measure of periodicity in speech.

16 Claims, 4 Drawing Sheets

OTHER PUBLICATIONS

W. B. Kleijn et al., "An Efficient Stochastically Excited Linear Predictive Coding Algorithm for High Quality Low Bit Rate Transmission of Speech", Speech Communication VII pp. 305-316 (1988).

P. Kroon and B. S. Atal, "Predictive Coding of Speech using Analysis-by-Synthesis Techniques", Advances in Speech Signal Processing pp. 141-164 (1991).

W. B. Kleijn et al., "Fast Methods for the CELP Speech Coding Algorithm", IEEE Trans. Acoust. Speech Sign. Proc. 38(8), pp. 1330-1342 (1990).

Chen and Gersho, "Real-Time Vector APC Speech Coding at 4800 BPS with Adaptive Postfiltering," Proc. Int. Conf. Acoustics, Speech, Sig. Proc., 1237-1241 (1987).

Gerson and Jasiuk "Vector Sum Excited Linear Prediction (VSELP)," Advances in Speech Coding, 69-80 (1990).

METHOD AND APPARATUS FOR SMOOTHING PITCH-CYCLE WAVEFORMS

This application is a continuation of application Ser. No. 07/778,560, filed on Oct. 18, 1991, now abandoned.

FIELD OF THE INVENTION

The present invention relates generally to speech communication systems and more specifically to signal processing associated with the reconstruction of speech from code words.

BACKGROUND OF THE INVENTION

Efficient communication of speech information often involves the coding of speech signals for transmission over a channel or network ("channel"). Speech coding can provide data compression useful for communication over a channel of limited bandwidth. Speech coding systems include a coding process which converts speech signals into code words for transmission over the channel, and a decoding process which reconstructs speech from received code words.

A goal of most speech coding techniques is to provide faithful reproduction of original speech sounds such as, e.g., voiced speech, produced when the vocal cords are tensed and vibrating quasi-periodically. In the time domain, a voiced speech signal appears as a succession of similar but slowly evolving waveforms referred to as pitch-cycles. A single one of these pitch-cycles has a duration referred to as the pitch-period.

In analysis-by-synthesis speech coding systems employing longterm predictors (LTPs), such as most code-excited linear predictive (CELP) speech coding known in the art, a frame (or subframe) of coded pitch-cycles is reconstructed by a decoder in part through the use of past pitch-cycle data by the decoder's LTP. A typical LTP may be interpreted as an all-pole filter providing delayed fedback of past pitch-cycle data, or an adaptive codebook of overlapping vectors of past pitch-cycle data. Past pitch-cycle data works as an approximation of present pitch-cycles to be decoded. A fixed codebook (e.g. a stochastic codebook) may be used to refine past pitch-cycle data to reflect details of the present pitch-cycles.

Analysis-by-synthesis coding systems like CELP, while providing low bit-rate coding, may not communicate enough information to completely describe the evolution of the pitch-cycle waveform shapes in original speech. If the evolution (or dynamics) of a succession of pitch-cycle waveforms in original speech is not preserved in reconstructed speech, audible distortion may be the result.

SUMMARY OF THE INVENTION

The present invention provides a method and apparatus for improving the dynamics of reconstructed speech produced by speech coding systems. Exemplary coding systems include analysis-by-synthesis systems employing LTPs, such as most CELP systems. Improvement is obtained through the identification and smoothing of one or more traces in reconstructed voiced speech signals. A trace refers to an envelope formed by like-features present in a sequence of pitch-cycles of a voiced speech signal. Identified traces are smoothed by any of the known smoothing techniques, such as linear interpolation or low-pass filtering. Smoothed traces are assembled by the present invention into a smoothed reconstructed signal. The identification, smoothing, and assembly of traces may be performed in the reconstructed speech domain, or any of the excitation domains present in analysis-by-synthesis coding systems.

DETAILED DESCRIPTION

Voiced Speech

Figure 1:
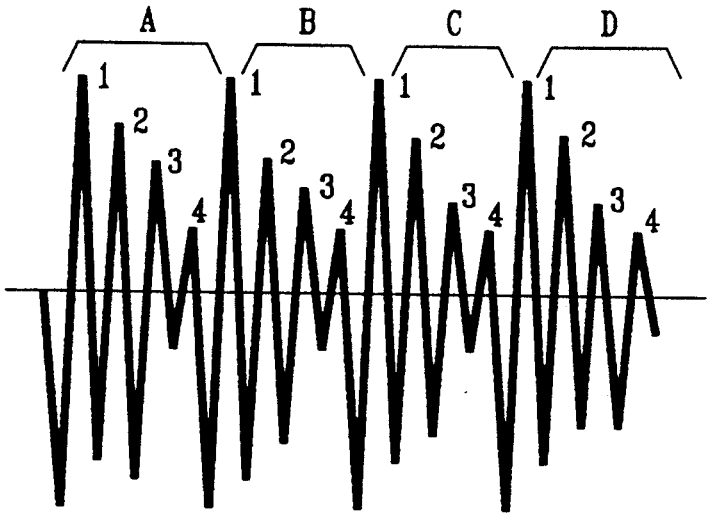
FIG. 1 presents a time-domain representation of a voiced speech signal.

FIG. 1 presents an illustrative stylized time-domain representation of a voiced speech signal (20 ms). As shown in the Figure, it is possible to describe voiced speech as a sequence of individual similar waveforms referred to as pitch-cycles. Generally, each pitch-cycle is slightly different from its neighbors in both amplitude and duration. The brackets in the Figure indicate a possible set of boundaries between successive pitch-cycles. Each pitch-cycle in this illustration is approximately 5 ms in duration.

A pitch-cycle may be characterized by a series of features which it may share in common with one or more of its neighbors. For example, as shown in FIG. 1, pitch-cycles A, B, C, and D, have characteristic signal peaks 1–4 in common. While the exact amplitude and location of peaks 1–4 may change with each pitch-cycle, such changes are generally gradual. As such, voiced speech is commonly thought of as periodic or nearly so (i.e., quasi-periodic).

Many speech coders, including many CELP coders, operate on a frame and subframe basis. That is, they operate on advantageously chosen segments of speech. For example, a CELP coder may transmit 20 ms frames of coded speech (160 samples at 8 kHz) by coding and assembling four 5 ms subframes, each with its own characteristic LTP delay. For purposes of the present description, the illustrative pitch-cycles shown in FIG. 1 correspond to 5 ms subframes. It will be apparent to one of ordinary skill in the art that the present invention is also applicable to situations where pitch-cycles and subframes do not coincide.

AN ILLUSTRATIVE EMBODIMENT

Figure 2:
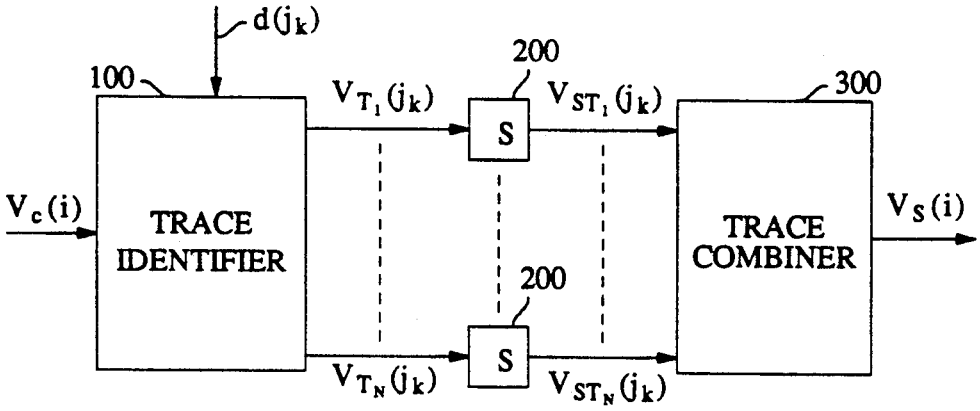
FIG. 2 presents an illustrative embodiment of the present invention.

An illustrative embodiment of the present invention is presented in FIG. 2. For each subframe, a trace identifier 100 receives a conventional reconstructed speech signal, $V_c(i)$, and a time-distance function, d(i), from a conventional decoder, such as a CELP decoder. The conventional reconstructed speech signal may take the form of speech itself, or any of the speech-like excitation signals present in conventional decoder. It is preferred that $V_c(i)$ be the excitation signal produced by the LTP of the decoder. Data from N traces, $V_{Tn}(j_k)$, $1 \leqq n \leqq N$, are identified and passed to a plurality of trace smoothing processes 200. These smoothing processes 200 operate to provide smoothed trace data, $V_{STn}(j_k)$, $1 \leqq n \leqq N$, to a trace combiner 300. Trace combiner 300 forms a smoothed speech signal, $V_s(i)$, from the smoothed trace data.

TRACE IDENTIFICATION

Figure 3:
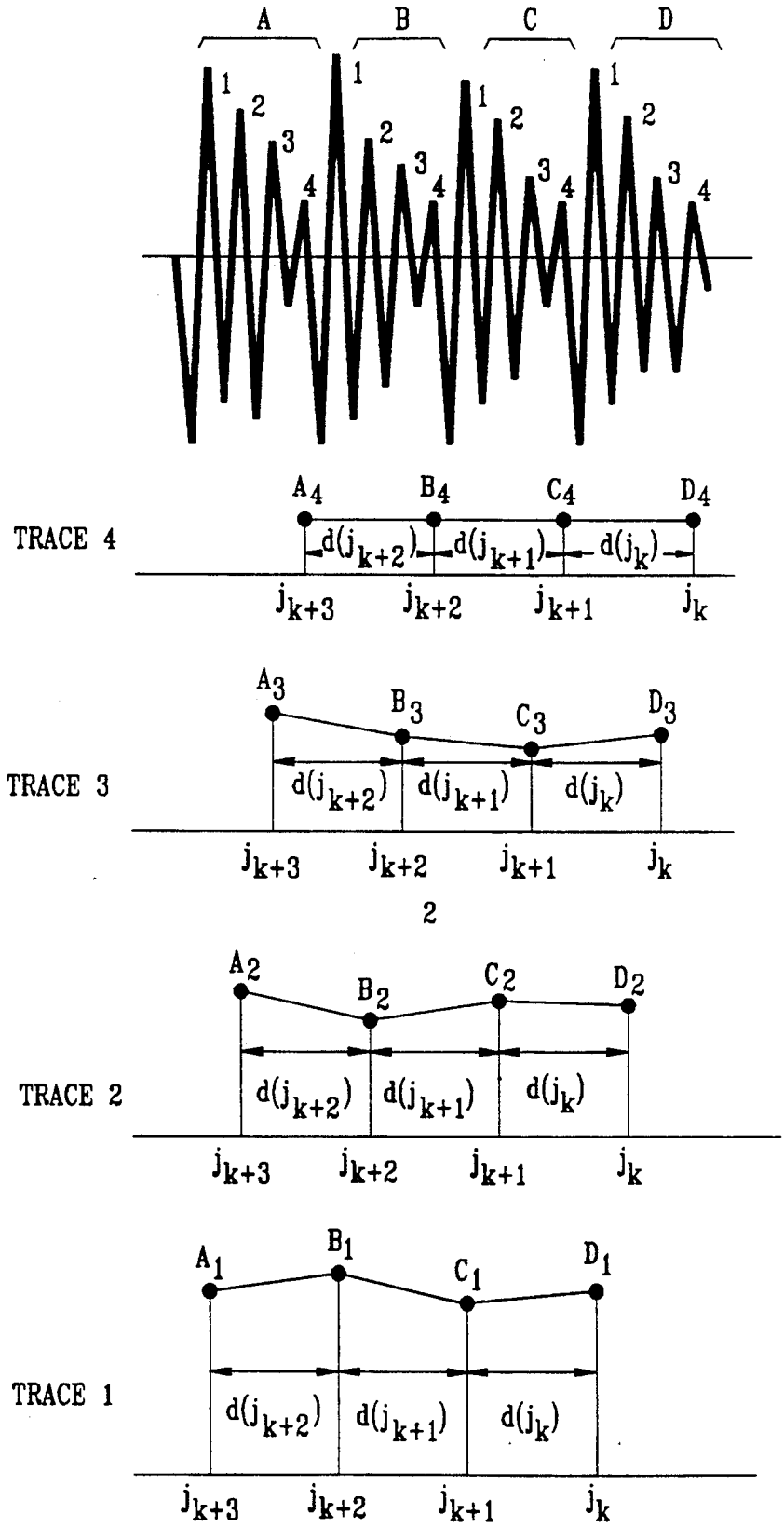
FIG. 3 presents illustrative traces for the time-domain representation of the voiced speech signal presented in FIG. 1.

The trace identifier 100 of the illustrative embodiment defines or identifies traces in speech. Each identified trace associates a series of like-features present in a sequence of pitch-cycle waveforms of a reconstructed speech signal. A trace is an envelope formed by the amplitude of samples of the reconstructed speech signal provided by a speech decoder, $V_c$, at times given by values of an index, $j_k$. As discussed above, an identified trace may be denoted as $V_{Tn}(j_k)$, k=0, 1, 2, . . . . An illustrative trace index, $j_k$, may be determined such that:

$$j_{k+1}=j_k-d(j_k)$$

for k=0, 1, 2, . . . , where $d(j_k)$ is the time-distance between like-features of the sequence of pitch-cycles in the reconstructed speech signal at time $j_k$ (as k increases, the index $j_k$ points farther into the past). FIG. 3 presents illustrative traces for certain sample points in a segment of the voiced speech (a frame) presented in FIG. 1. Illustrative values for the time-distance function, d(i), may be obtained from a conventional LTP-based decoder providing frames or subframes of the reconstructed speech signal. For example, when the present invention is used in combination with a CELP coding system having an LTP, d(i) is the delay used by the LTP of the CELP decoder. A typical CELP decoder for use with this embodiment of the present invention provides a delay for each frame of coded speech. In such a case, d(i) is constant for all sample points in the frame.

A trace need not be identified in non-voiced speech (that is, speech which comprises, for example, silence or unvoiced speech). For voiced speech, a trace may extend backward and forward in time from a given point in time. There may be as many traces in a given pitch-cycle as there are data samples (e.g., at an 8 kHz sampling rate, 40 traces in a 5 ms pitch-cycle). When pitch-cycles expand over time, certain traces may split into multiple traces. When pitch-cycles contract over time, certain traces may end. Furthermore, because values of d(i) may exceed a single pitch-period, a trace may associate like-features in waveforms which are more than one pitch-cycle apart.

TRACE SMOOTHING

Traces identified in a reconstructed speech signal are smoothed by smoothing processes 200 as a way of modifying the dynamics of reconstructed pitch-cycle waveforms. Any of the known data smoothing techniques, such as linear interpolation, polynomial curve fitting, or low-pass filtering, may be used. A smoothing technique is applied to each trace over a time interval, such as a 20 ms frame provided by a CELP decoder.

Figure 4:
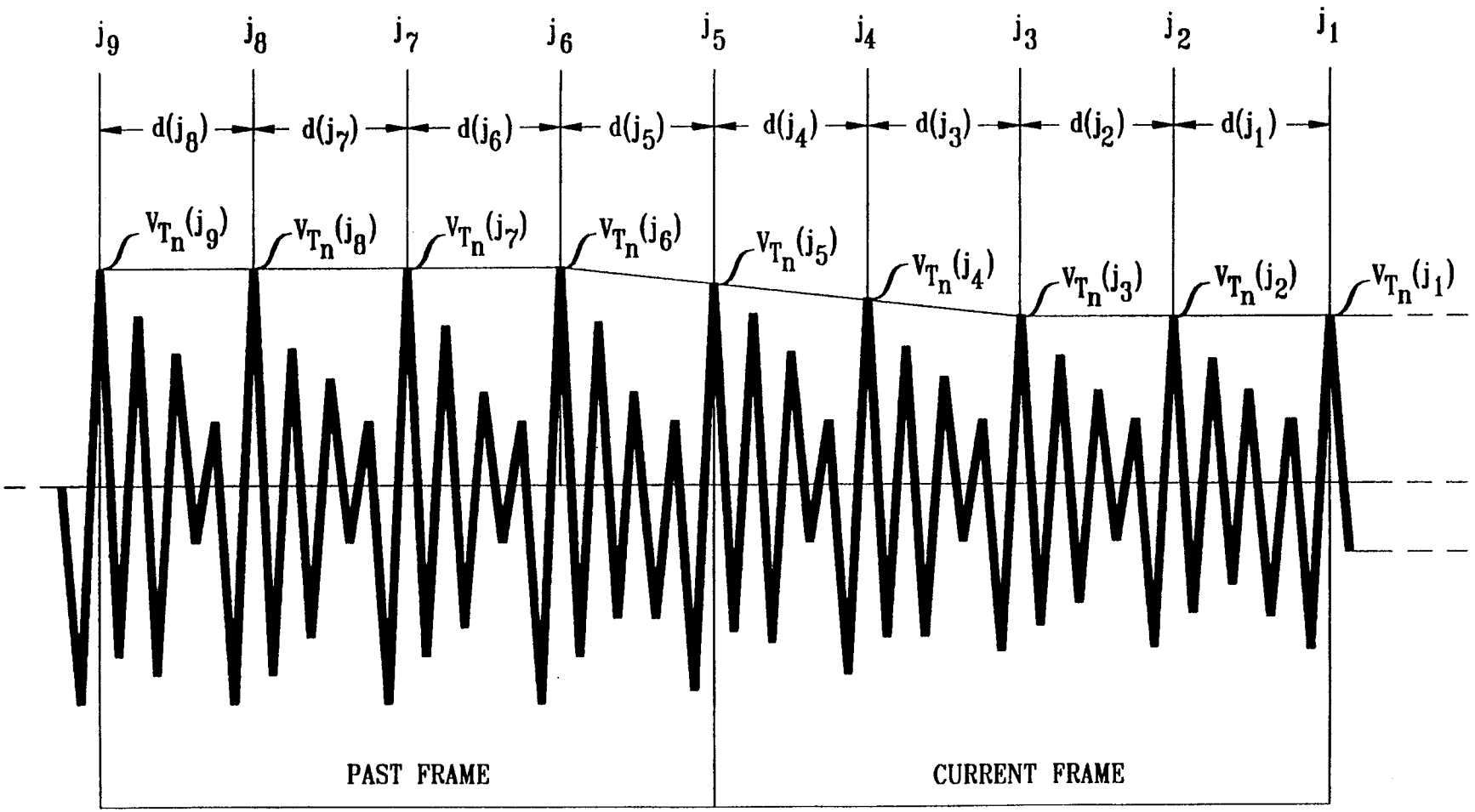
FIG. 4 presents illustrative frames of a speech signal used in trace smoothing.

FIG. 4 presents illustrative frames of a reconstructed speech signal used in the smoothing of a single trace, $T_n$, by the embodiment of FIG. 2. An exemplary smoothing process 200 maintains past trace values (from a past frame of the signal) which are used in establishing an initial data value for a smoothing operation on a current frame of the speech signal. The trace of the current frame comprises a set of values $\{V_{Tn}(j_k), k=1, 2, 3, 4\}$. The trace values are separated in time by a set of delays $\{d(j_k), K=1, 2, 3, 4\}$. Delay $d(j_4)$ is used by the smoothing process 200 to identify the first (i.e., earliest in time) trace value for use in the smoothing operation of the current frame of the trace. In the Figure, this trace value is obtained from the past frame trace values: $V_{Tn}(j_5)$. Smoothing may be provided by interpolation of the set of trace values $\{V_{Tn}(j_k), k=1, 2, 3, 4, 5\}$ to yield a set of smoothed trace values $\{V_{STn}(j_k)\ k=1, 2, 3, 4, 5\}$. It is preferred that a smoothed trace for a given current frame connect with its associated smoothed trace from the immediate past frame. An illustrative interpolation technique defines a line-segment connecting the last trace value of the given frame, $V_{Tn}(j_1)$, with the last trace value of the previous frame, $V_{Tn}(j_5)$ as the smoothed trace in the frame, (as such, $V_{STn}(j_1)=V_{Tn}(j_1)$ and $V_{STn}(j_5)=V_{Tn}(j_5)$). Once smoothing of a current frame is performed, trace data of the current frame is saved for subsequent use as trace data of a past frame. Thus, smoothing proceeds on a rolling frame-by-frame basis.

COMBINING SMOOTHED TRACES

Individual smoothed trace samples, $V_{STn}(j_k)$, are combined on a rolling frame-by-frame to form a smoothed reconstructed speech signal, $V_s(i)$, by trace combiner 300. Trace combiner 300 produces smoothed reconstructed speech signal, $V_s(i)$, by interlacing samples from individual smoothed traces in temporal order. That is, for example, the smoothed trace having the earliest sample point in the current frame becomes the first sample of the frame of smoothed reconstructed speech signal; the smoothed trace having the next earliest sample in the frame supplies the second sample, and so on. Typically, a given smoothed trace will contribute one sample per pitch-cycle of a smoothed reconstructed speech signal. The smoothed reconstructed speech signal, $V_s(i)$, may be provided as output to be used in the manner intended for the unsmoothed version of the speech signal.

COMBINING SMOOTHED AND CONVENTIONAL RECONSTRUCTED SPEECH

Figure 5:
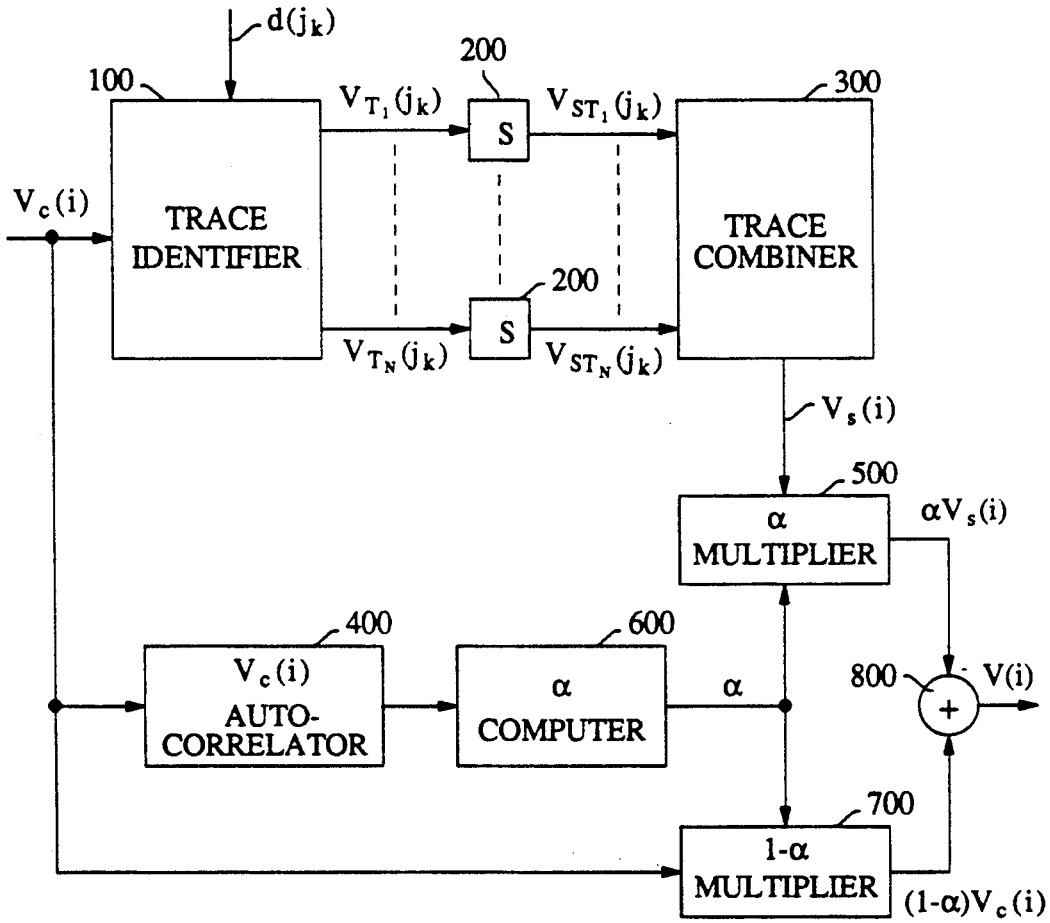
FIG. 5 presents an illustrative embodiment of the present invention which combines smoothed and conventional reconstructed speech signals according a proportionality measure of voiced and non-voiced speech.

In an illustrative embodiment of the present invention presented in FIG. 5, an overall reconstructed speech signal, V(i), may be considered to be a linear combination of a conventional reconstructed speech signal, $V_c(i)$, and a smoothed reconstructed speech signal, $V_s(i)$, as follows:

$$V(i)=\alpha V_s(i)+(1-\alpha)V_c(i),$$

where $0 \leqq \alpha \leqq 1$ (see, FIG. 5, 500–800). The parameter $\alpha$, a measure of periodicity, is used to control the proportion of smoothed and conventional speech in V (i). Because $V_s$ is significant as a manipulation of a voiced speech signal, $\alpha$ operates to provide for V(i) a larger proportion of $V_s(i)$ when speech is voiced, and a larger proportion of $V_c(i)$ when speech is non-voiced. A determination of the presence of voiced speech, and hence a value for $\alpha$, may be made from the statistical correlation of adjacent frames of $V_c(i)$. An estimate of this correlation may be provided for a CELP decoder by an autocorrelation expression:

$$R_{ab}(d(*)) = \sum_{i=0}^{i=L} a(i)b(i-d(i)).$$

where d(i) is the delay from the LTP of the CELP decoder and L is the number of samples in the autocorrelation expression, typically 160 samples at an 8 kHz sampling rate (i.e., the number of samples in a frame of the speech signal) (see, FIG. 5,400). This expression may be used to compute a normalized estimate for $\alpha$:

$$\alpha = \frac{R_{V_cV_c}(d(*))}{R_{V_cV_c}(0)}.$$

The greater the autocorrelation, the more periodic the speech, and the greater the value of $\alpha$ (see, FIG. 5,500). Given the expression for V(i), large values for $\alpha$ provide large contributions to V(i) by $V_s$, and visa-versa.

FURTHER ILLUSTRATIVE EMBODIMENTS

A further illustrative embodiment of the present invention concerns smoothing a subset of traces available from a reconstructed speech signal. One such subset can be defined as those traces associated with sample data of large pulses within a pitch-cycle. Of course, these large pulses form a subset of pulses within the pitch-cycle. For example, with reference to FIG. 1, this illustrative embodiment may involve smoothing only those traces associated with samples of the speech signal associated with pulses 1–3 of each pitch-cycle. Identification of a subset of pulses to include in the smoothing process can be made by establishing a threshold below which pulses, and thus their traces, will not be included. This threshold may be established by an absolute level or a relative level as a percentage of the largest pulses. Moreover, because the audible results of smoothing can be subjective, the threshold may be selected from experience based upon several test levels. In this embodiment, assembly of smoothed traces into a smoothed reconstructed speech signal may be supplemented by the original reconstructed speech signal for which no smoothing has occurred. Such original reconstructed speech signal samples are those samples which fall below the above-mentioned threshold. As a result, such samples do not form part of a trace which is smoothed.

As discussed above, the original reconstructed speech signal may be in the speech domain itself, or it may be in one of the excitation domains available in analysis-by-synthesis decoders. If the speech domain is used, the illustrative embodiments of the present invention may follow a conventional analysis-by-synthesis decoder. However, should the speech signal be in an excitation domain, such as the case with the preferred embodiment, the embodiment would be located within such decoder. As such, the embodiment would receive the excitation domain speech signal, process it, and providing a smoothed version of it to that portion of the decoder which expects to receive the excitation speech signal. In this case, however, it would receive the smoothed version provided by the embodiment.

I claim:

1. A method for reducing audible distortion in a first speech signal which has been reconstructed by a decoder based on coded speech information, the method comprising the steps of:

forming one or more trace signals based on the first speech signal provided by the decoder, each such trace signal formed by sequentially selecting first speech signal samples which are separated in time by a delay provided by the decoder, wherein the delay is a time separation between like-feature samples in pitch-cycles of the first speech signal;

smoothing one or more of the trace signals; and forming a second speech signal by combining one or more of the smoothed trace signals.

2. The method of claim 1 wherein the first speech signal is provided by a long term predictor of the decoder.

3. The method of claim 1 wherein the delay is provided by a long term predictor of the decoder.

4. The method of claim 1 wherein the step of forming one or more trace signals comprises the step of forming trace signals associated with a subset of pulses in a pitch-cycle.

5. The method of claim 1 wherein the step of smoothing one or more of said trace signals is performed by interpolation.

6. The method of claim 1 wherein the step of smoothing one or more of said trace signals is performed by low-pass filtering.

7. The method of claim 1 wherein the step of smoothing one or more of said trace signals is performed by polynomial curve fitting.

8. The method of claim 1 further comprising the step of combining values of the first speech signal with values of the second speech signal.

9. The method of claim 8 wherein the step of combining values of the first speech signal with values of the second speech signal is based on a measure of periodicity.

10. An apparatus for reducing audible distortion in a first speech signal which has been reconstructed by a decorder based on coded speech information, the apparatus comprising:

a trace identifier for forming one or more trace signals based on the first speech signal, each such trace signal formed by sequentially selecting first speech signal samples which are separated in time by a delay provided by the decoder, wherein the delay is a time separation between like-feature samples in pitch-cycles of the first speech signal;

one or more smoothing processors, coupled to the trace identifier, for smoothing one or more of the trace signals; and a trace combiner, coupled to the one or more smoothing processors, for forming a second speech signal by combining one or more of the smoothed trace signals.

11. The apparatus of claim 10 wherein the first speech signal is provided by a long term predictor of the decoder.

12. The apparatus of claim 10 further comprising:

means for determining periodicity of speech;

means, coupled to the means for determining periodicity of speech, for combining values of the first speech signal with values of the second speech signal based on a measure of periodicity.

13. The apparatus of claim 12 wherein the means for determining periodicity of speech comprises means for determining an autocorrelation of the first speech signal.

14. The apparatus of claim 13 wherein the means for determining periodicity of speech further comprises means for determining a measure of periodicity of the first speech signal.

15. The apparatus of claim 12 wherein the means for determining periodicity of speech comprises means for determining an autocorrelation of the second speech signal.

16. The apparatus of claim 15 wherein the means for determining periodicity of speech further comprises means for determining a measure of periodicity of the second speech signal.

* * * * *